United States Patent [19]

George et al.

[11] Patent Number: 4,969,525

[45] Date of Patent: Nov. 13, 1990

[54] FIRING HEAD FOR A PERFORATING GUN ASSEMBLY

[75] Inventors: Kevin R. George, Columbus; David S. Wesson, Waxahachie; John E. Avila, Katy, all of Tex.

[73] Assignee: Halliburton Company, Duncan, Okla.

[21] Appl. No.: 402,387

[22] Filed: Sep. 1, 1989

[51] Int. Cl.[5] ..... E21B 43/117

[52] U.S. Cl. ..... 166/297; 166/55; 175/4.52; 175/4.54; 102/319

[58] Field of Search ..... 166/55, 297; 175/4.52, 175/4.53, 4.54, 4.55, 4.56, 4.57, 4.6, 3.5; 102/205, 216, 275.7, 275.8, 312, 313, 319, 320, 321

[56] References Cited

U.S. PATENT DOCUMENTS

| | | | |
|---|---|---|---|
| 4,509,604 | 4/1985 | Upchurch | 175/4.52 |
| 4,523,643 | 6/1985 | McGlothen | 166/297 |
| 4,531,590 | 7/1985 | Peterson | 175/4.52 |
| 4,648,470 | 3/1987 | Gambertoglio | 175/4.54 |
| 4,836,109 | 6/1989 | Wesson et al. | 102/312 |
| 4,862,964 | 9/1989 | George et al. | 175/4.52 |

OTHER PUBLICATIONS

Exhibit A—Vann Systems Engineering Well Completion Product Catalog No. VS-0001, pp. TCP-1001, TCP-1011, TCP-1013, TCP-1022, TCP-1014, TCP-1016, TCP-1020 and TCP-1018, published by Vann Systems of Houston, Texas, a division of Halliburton Company.

*Primary Examiner*—Ramon S. Britts
*Assistant Examiner*—Terry Lee Melius
*Attorney, Agent, or Firm*—James R. Duzan; L. Wayne Beavers

[57] ABSTRACT

A hydraulically actuated firing head for a tubing conveyed well perforating system includes an actuating piston responsive to a differential between tubing pressure and a sealed low pressure zone contained within the firing head. The actuating piston releases a firing piston which initiates a firing sequence.

20 Claims, 3 Drawing Sheets

FIRING HEAD FOR A PERFORATING GUN ASSEMBLY

BACKGROUND OF THE INVENTION

1. Field Of The Invention

The present invention relates generally to tubing conveyed perforating systems, and particularly to such systems which are hydraulically actuated.

2. Description Of The Prior Art

One well known manner of completing an oil or gas well is through the use of a tubing conveyed completion system. A production tubing string has a packer located near a lower end thereof, and has a perforating gun suspended from the tubing string below the packer. The tubing string is lowered into place and the packer is set thus isolating the zone of the well below the packer. The perforating gun is then actuated to perforate the well casing adjacent the isolated zone and to allow formation fluid to immediately be produced up through the tubing string.

Many different techniques are known for actuating such tubing conveyed perforating guns. They can be mechanically actuated through use of a drop bar or slick line, and they can be hydraulically actuated by applying fluid pressure through a selected passageway.

It is also known to provide dual firing systems for a tubing conveyed perforating gun.

U.S. Pat. No. 4,836,109 to Wesson et al., and assigned to Halliburton Company, the assignee of the present invention, discloses a hydraulically actuated primary firing head utilizing a differential pressure actuating piston. The high pressure side of the actuating piston is communicated with well annulus pressure through a control line which extends below the packer. The low pressure side of the actuating piston is communicated with the isolated zone of the well. When the actuating piston is moved in response to an increase in well annulus pressure as communicated through the control line, a firing piston is released to initiate the firing of the perforating gun. A backup firing head is placed up on top of the primary firing head to provide an alternate means of firing the gun in the event the primary firing head fails to function or well conditions preclude the use of one of the systems after reaching total depth.

Other firing heads typical of those utilized by the assignee of the present invention include various mechanical and hydraulically actuated firing heads as shown on pages TCP-1001, TCP-1011, TCP-1013, TCP-1022, TCP-1014, TCP-1016, TCP-1020 and TCP-1018 of the Vann Systems Engineering Well Completion Product Catalog No. VS-0001 published by Vann Systems of Houston, TX, a division of Halliburton Company. Some of these structures such as the Time Delay Firing Head at pages TCP-1013, and the Pressure Actuated Firing Head at pages TCP-1022, contain a single actuating piston which also initiates the firing sequence, and is movable in response to an increase in tubing pressure.

U.S. Pat. No. 4,509,604 to Upchurch, and assigned to Schlumberger Technology Corporation discloses another pressure responsive tubing conveyed perforating system. It includes an actuating piston having its high pressure side communicated with the well annulus above the packer, and its low pressure side is communicated with the isolated zone of the well. Movement of the actuating piston releases a firing piston which initiates the firing sequence.

U.S. Pat. No. 4,523,643 to McGlothen, and assigned to Dresser Industries, Inc., discloses another hydraulically actuated tubing conveyed perforating system which operates in response to annulus pressure communicated from above the packer through a control line.

SUMMARY OF THE INVENTION

The present invention provides a firing head designed to be actuated in response to tubing pressure as referenced to a substantially atmospheric pressure sealed low pressure chamber within the tool.

The firing head includes a housing having an actuating port disposed through a wall thereof and communicated with an isolated zone of the well below the packer.

A differential pressure actuating piston is slidably disposed in the housing, and with the housing defines a first chamber communicated with the isolated well zone through the actuating port in the housing, which first chamber is communicated with a high pressure side of the actuating piston.

The actuating piston and housing further define a sealed low pressure chamber communicated with a low pressure side of the actuating piston.

A releasable retaining means, such as a shear set, is operably associated with the actuating piston for holding it in a first position until pressure in the isolated well zone exceeds a predetermined value.

A firing piston is also slidably disposed in the housing. A releasable interlocking means operably associated with both the actuating piston and the firing piston initially holds the firing piston in place relative to the housing until the actuating piston is moved in response to an increase in fluid pressure within the tubing string and the isolated zone above the mentioned predetermined value.

A backup firing head may also be utilized in conjunction with the previously mentioned primary firing head to provide an alternative means for firing the guns.

Methods of perforating a well utilizing the firing head are also disclosed.

Also disclosed are systems having dual firing heads with dual time delays all mounted on top of a perforating gun.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
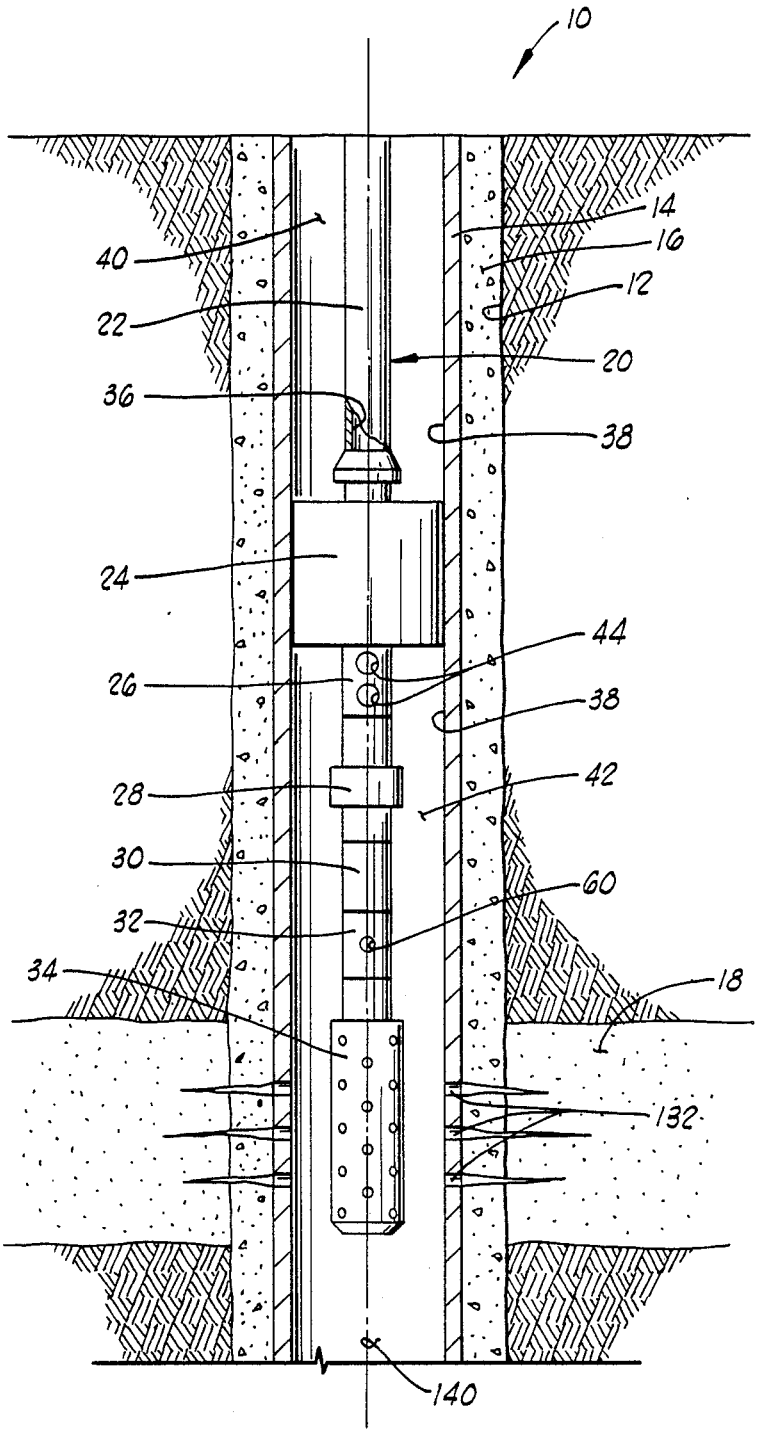
FIG. 1 is a schematic elevation view of a tubing conveyed perforating system in accordance with the present invention.

Referring now to the drawings, and particularly to FIG. 1, a well is thereshown and generally designated by the numeral 10. The well 10 is constructed by first forming a bore hole 12 within which is placed a well casing 14 which is cemented in place as indicated at 16.

The well 10 intersects a subsurface formation 18 from which it is desired to produce oil and/or gas.

A tubing conveyed perforating system generally designated by the numeral 20 is shown in place within the well 10.

The system 20 includes a tubing string 22, packer 24, vent 26, mechanical release 28, backup firing head 30, primary firing head 32, and perforating gun 34.

The tubing string 22 has a tubing bore 36.

The packer 24 may be a retrievable packer conveyed on the tubing string 22, or may be a permanent packer through which the tubing string 22 and the other components are stabbed in place. The packer 24 provides a means for sealing between the tubing string 22 and a bore 38 of casing 14 which may also be referred to as a casing bore or well bore 38. This defines a well annulus 40 between tubing string 22 and well bore 38 above the packer 24, and defines an isolated zone 42 of well 10 below the packer 24.

The vent 26 is located below the packer 24 and is communicated with the tubing bore 36. Vent 26 includes a plurality of openings 44 which communicate the tubing bore 36 with the isolated zone 42, so that fluid pressures within the tubing bore 36 and the isolated zone 42 are substantially equal.

The perforating gun 34 is suspended from the tubing string 22 in the isolated zone 42 adjacent the subsurface formation 18 which is to be perforated.

Also suspended from the tubing string 22 and located above the perforating gun 34 are the primary firing head 32 and the backup firing head 30. Located above the backup firing head 30 is a mechanical release 28 which may be utilized to drop the perforating gun 34 and the firing heads after the well has been perforated, in a well known manner.

Figure 2A:
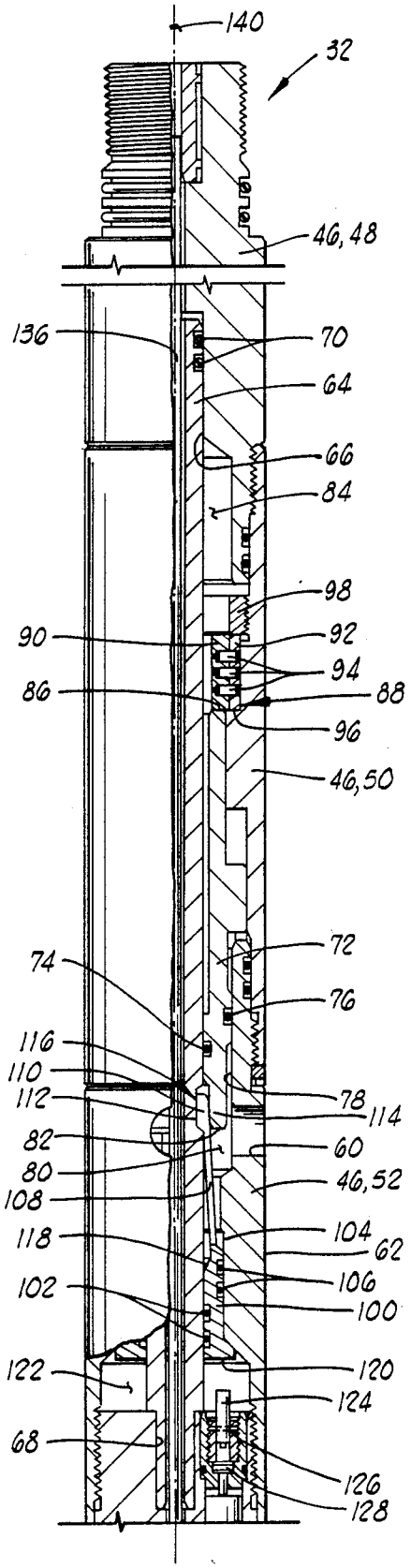
FIGS. 2A–2B comprise an elevation, partly sectioned view of the primary firing head.
Figure 2B:
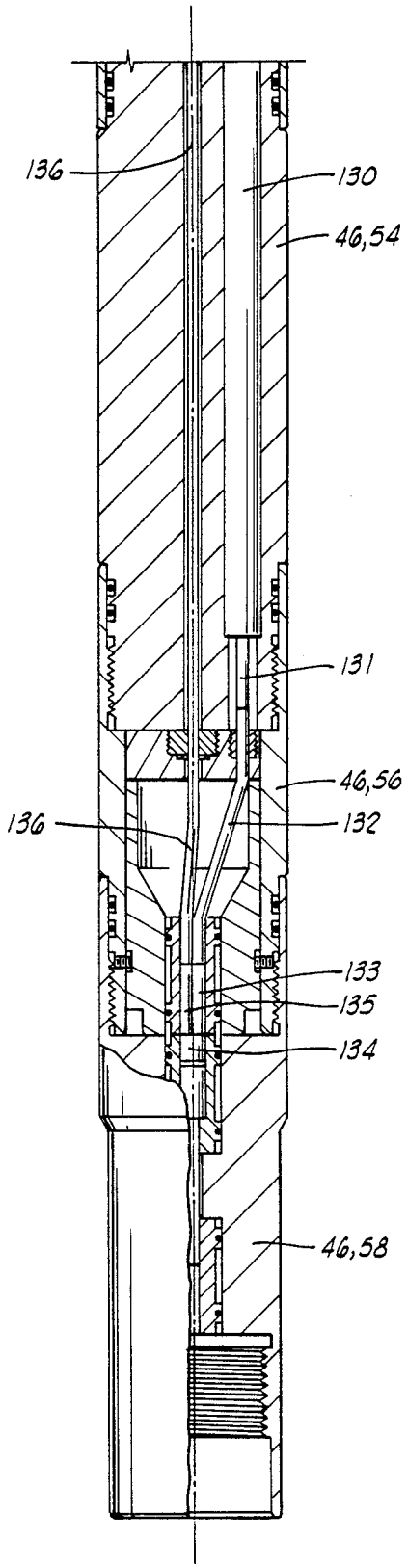

The details of construction of the primary firing head 32 are shown in FIGS. 2A-2B. The firing head 32 includes a housing generally designated by the numeral 46. The housing 46 is constructed in an elongated generally cylindrical shape and is made up of several housing sections which are suitably threaded together with seals provided between the sections. The housing 46 includes, from top to bottom, an upper connector sub 48, an upper housing section 50, a ported intermediate housing section 52, a time delay housing section 54, a bottom housing section 56, and a bottom connector sub 58.

The intermediate housing section 52 has an actuating port 60 disposed through a wall thereof and communicated with an exterior 62 of the housing 46.

An inner mandrel 64 is axially located within the housing 46 and has its upper and lower ends received within counterbores 66 and 68 of upper connector sub 48 and time delay housing section 54, respectively. O-ring seals 70 are provided between the upper end of inner mandrel 64 and the counterbore 66 of upper connector sub 48.

A differential pressure actuating piston 72 is slidably disposed in the housing 42 in an annular space between inner mandrel 64 and the housing 42. Actuating piston 72 includes an inner O-ring seal 74 slidably sealing against the outer surface of inner mandrel 64, and includes an outer O-ring seal 76 slidably sealing against a counterbore 78 of intermediate housing section 52.

A first chamber 80, which may also be referred to as a high pressure chamber 80, is defined between inner mandrel 64 and housing 46 below and in communication with the actuating piston 72. A downward facing irregular annular surface 82 of actuating piston 72, the area of which is defined between seals 74 and 76, can be generally referred to as a high pressure side 82 of actuating piston 72. The high pressure side 82 of piston 72 is communicated with the high pressure chamber 80 and through the actuating port 60 with the isolated zone 42 of the well 10.

A second chamber 84, which may also be referred to as a sealed low pressure chamber 84, is also defined between inner mandrel 64 and housing 46 with its lower end being defined by actuating piston 72. The upper end of low pressure chamber 84 is sealed by seals 70 and the lower end of low pressure chamber 84 is sealed by the sliding seals 74 and 76 of actuating piston 72.

The low pressure chamber 84 is communicated with an irregular annular shaped upward facing surface 86 of actuating piston 72 which may be generally referred to as a low pressure side 86 of actuating piston 72.

The sealed low pressure second chamber 84 contains air at substantially atmospheric pressure as is found therein when the firing head 32 is initially assembled prior to placement in the well 10.

In the illustrated preferred embodiment a shear set 88, which may also be referred to as a releasable retaining means 88, is operably associated with the actuating piston 72 for holding the actuating piston 72 in its first position as shown in FIG. 2A until pressure in the isolated zone 42 and thus in the high pressure chamber 80, exceeds a predetermined value. The predetermined value is determined by the construction of the shear set 88. The shear set 88 includes inner and outer sleeves 90 and 92 held together by a plurality of shear pins 94. The outer sleeve 92 is held in place relative to housing 46 between a shoulder 96 and a locking nut 98 which is threadedly connected to upper housing section 50. It will be appreciated that other forms of releasable retaining means may be utilized in place of shear set 88.

A bottom surface of inner sleeve 90 is abutted by the upper end 86 of actuating piston 72 when the actuating piston 72 is in its initial position.

When the pressure in isolated zone 42 and thus in high pressure chamber 80 reaches the predetermined value, the shear pins 94 will shear allowing the inner sleeve 90 and the actuating piston 72 to move upward relative to the housing 46.

The firing head 32 also includes a firing piston 100 slidably disposed in the housing 46. Firing piston 100 is an annular piston slidably received about the inner mandrel 64 with sliding seals 102 being provided therebetween. Firing piston 100 is also slidably received within a counterbore 104 of intermediate housing section 52 with sliding O-ring seals 106 being provided therebetween.

A plurality of resilient collet fingers 108 having enlarged heads 110 on their upper end are integrally constructed with and extend upward from the firing piston 100. In the initial position of the various components of firing head 32, the enlarged heads 110 of collet fingers 108 are received in an outer annular groove 112 defined in inner mandrel 64, and are held in place therein by a downwardly extending annular skirt 114 of actuating piston 72.

The collet fingers 108 with enlarged heads 110, the groove 112, and the skirt 114 may be collectively referred to as a releasable interlocking means, generally designated by the numeral 116, operably associated with both the actuating piston 72 and the firing piston 100 for holding the firing piston 100 in place relative to the housing 46 until the actuating piston 72 is moved from its first position.

The firing piston 100 is also a differential pressure piston and it has its high pressure end 118 communicated with the high pressure chamber 80 and thus through port 60 with isolated zone 42 of well 10. The firing piston 100 has a low pressure end 120 communicated with a sealed low pressure chamber 122 which contains air at substantially atmospheric pressure.

When the fluid pressure in tubing string 22 and isolated zone 42 is increased to the predetermined value so as to shear the shear set 88 thus moving the actuating piston 72 upward within housing 46, the releasable interlock means 116 releases firing piston 100 allowing it to be moved downward and to strike a firing pin 124. A small shear pin 126 holding firing pin 124 is sheared and firing pin 124 moves down striking a percussion initiator 128 which initiates the firing sequence.

In the preferred embodiment illustrated, a pyrotechnic time delay fuse 130 is interposed immediately below the initiator 128 so as to provide a sufficient time delay between movement of the firing piston 100 and the subsequent firing of the perforating gun 34 so that the fluid pressure in tubing string 22 and isolated zone 42 may be reduced to create an underbalanced condition in the well 10. A typical time delay as provided by the time delay fuse 130 is on the order of seven minutes. As a result of this underbalanced condition, when the perforating gun 34 does fire to create perforations 132 through the well casing 14 and cement 16 to communicate the isolated zone 42 with the subsurface formation 18, formation fluid can immediately and rapidly flow into the isolated zone 42 and inward through vents 44 and on upward through the tubing bore 36.

A primary detonating cord 132 extends from the lower end of time delay fuse 130 to a second initiator 134, which continues to fire in sequence so that the perforating gun 34 is ultimately fired. Boosters 131 and 133 are placed at each end of detonating cord 132.

Although a preferred embodiment of the firing head 32 has been illustrated including the time delay fuse 130, it will be appreciated that for a job where the time delay function is not desired, the firing head 32 may be constructed without the time delay fuse 130, so that the firing sequence initiated by firing piston 100 proceeds very rapidly to fire the perforating gun 34 within a matter of milliseconds after release of the firing piston 100.

The backup firing head 30 is located on top of primary firing head 32 as schematically illustrated in FIG. 1. A backup detonating cord 136 extends from backup firing head 30 down through an axial bore of inner mandrel 64 and terminates adjacent a booster 135 and which leads to the second initiator 134, so that if necessary the backup firing head 30 can be utilized to initiate the firing sequence.

The backup firing head 30 may be constructed according to any one of many previously known designs. For example, the various firing heads shown in Vann Systems Engineered Well Completion Product Catalog No. VS-0001, at pages TCP-1001, TCP-1011, TCP-1013, TCP-1022, TCP-1016 and TCP-1018, published by Vann Systems, a division of Halliburton Company, all of which is incorporated herein by reference, may be utilized.

More particularly, the backup firing head 30 may be of either the mechanically initiated or the hydraulically initiated type. A typical mechanically initiated backup firing head would be constructed similar to the Mechanical Firing Head Model II-D shown at page TCP-1011 of the referenced Vann Systems Catalog. A typical hydraulically actuated backup firing head would be the Time Delayed Firing Head as shown at page TCP-1013 of the referenced Vann Systems Catalog.

If a hydraulically actuated backup firing head such as the Vann Systems Time Delayed Firing Head is utilized which is actuated by tubing pressure, it is necessary that the backup firing head be constructed so as to be actuated in response to a tubing pressure substantially different from the predetermined value at which the releasable shear set 88 of primary firing head 32 is constructed to be actuated. This can readily be accomplished by an appropriate choice of shear pins for the release of each mechanism. Typically, the backup firing head would be set to actuate at a higher pressure than that of the primary firing head, although it could be set at a lower pressure so that the backup firing head would in fact be actuated at the lowest pressure and thus would be the firing head initially relied upon to fire the perforating gun 34.

Figure 3:
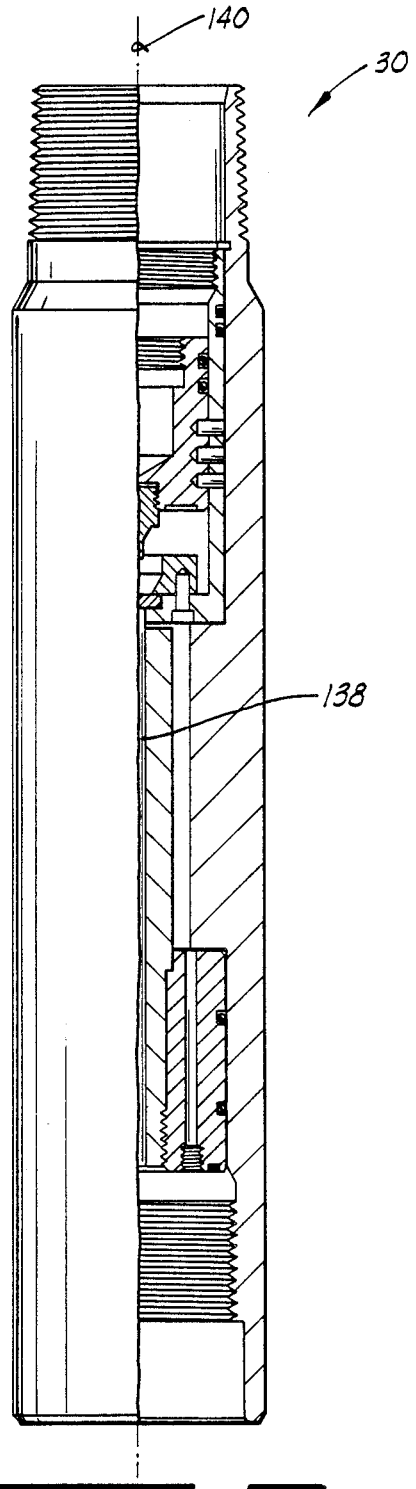
FIG. 3 is an elevation, partly sectioned view of a preferred backup firing head.

A hydraulically actuated backup firing head 30 like the Vann Systems Time Delayed Firing Head of page TCP-1013, referenced above, is shown in FIG. 3. The time delay firing head includes a time delay fuse 138 similar to the time delay fuse 130 of primary firing head 32. With use of the backup firing head 30 of FIG. 3, a dual initiated firing head system including two parallel time delay elements is provided which is mounted completely on top of the perforating gun 34. The time delay element of each of the firing heads provides a means for providing a sufficient time delay between the initiation of a firing sequence in the respective firing head and subsequent firing of the perforating gun 34, so that the previously mentioned underbalanced condition may be created in the isolated zone 42 of the well prior to firing of the perforating gun 34. As is apparent with reference to FIGS. 2 and 3, with this preferred combination, the time delay fuse 138 of the backup firing head 30 is located substantially along a longitudinal axis 140 of the perforating gun and firing head assembly. The time delay fuse 130 of primary firing head 32 is radially offset from the axis 140.

It will be appreciated that certain aspects of the invention, such as the top mounted dual time delay system just described, are not necessarily used with a packer between the tubing string and the casing. Particularly in situations such as horizontal drilling it may be appropriate to run the top mounted dual time delay system without a packer above it.

Operation

The apparatus just described can be utilized to perforate the well 10 in the following manner.

The perforating gun 34 and primary firing head 32 are provided and are made up with the other illustrated components on the tubing string 22.

Then, the perforating gun 34 and firing head 32 are lowered on the tubing string 22 to a selected location in the well 10 adjacent the subsurface formation 18 which is to be perforated.

A seal is provided by packer 24 between the tubing string 22 and the well bore 38 to define the well annulus 40 above the packer 24 and the isolated zone 42 below the packer 24. The packer 24 can either be a retrievable packer which is lowered into the well with the tubing string 22 and then set within the well bore 38, or it can be a permanent packer which has previously been set within the well bore 38 and through which the tubing string 22 and associated apparatus are stabbed into place.

The isolated zone 42 is communicated with the tubing bore 36 through the openings 44 of vent 26. The perforating gun 34 and firing head 32 are located in the isolated zone 42, and the isolated zone 42 is communicated through port 60 with both the actuating piston 72 and the firing piston 100. The low pressure side 86 of actuating piston 72 is communicated with the sealed low pressure chamber 84.

It will be appreciated that when the tubing string 22 and its associated apparatus are first lowered into place within the well 10, the perforations 132 illustrated in FIG. 1 will not be present. The isolated zone 42 of the well 10 will be separated from the subsurface formation 18 and the pressure of formation fluids contained therein by the unperforated well casing 14.

When it is desired to fire the perforating gun 34 to form the perforations 132 and allow formation fluid to be produced from subsurface formation 18 up through sealed zone 42 and in through the openings 44 of vent 26 and then upward through the tubing bore 36, this is initiated by increasing the fluid pressure in the tubing bore 22 and thus in the isolated zone 42. The fluid pressure in tubing string 22 and the isolated zone 42 is increased to a predetermined value at which the shear pins 94 of shear set 88 shear thus allowing the actuating piston 72 to be moved upward within housing 46 in response to this increased fluid pressure.

The upward movement of actuating piston 72 releases the firing piston 100 thus allowing it to be moved downward within housing 46 by this same fluid pressure.

The downward moving firing piston 100 strikes the firing pin 124 which then moves downward to strike the initiator 128 thus initiating the firing sequence.

The time delay fuse 130 provides a time delay of, for example, approximately seven minutes in this firing sequence after the actuating piston is moved and before the firing of the perforating guns 34.

During that time delay, the fluid pressure within tubing string 22 and thus within the isolated zone 42 can be reduced to a value substantially below that of the formation fluid contained in subsurface formation 18 to provide an underbalanced condition. Then, after the time delay the perforating gun 34 will fire creating the perforations 132. Since the pressure within the isolated zone 42 has been reduced to substantially below that of the formation fluids in formation 18, those formation fluids will rapidly flow out of formation 18 into the isolated zone 42, then through the vent 26 and upward through the tubing string 22.

In the event that there is a malfunction of the primary firing head 32, the firing of perforating gun 34 can be initiated with the backup firing head 30.

Typically, the shear set 88 will be constructed so as to shear at a pressure within isolated zone 42 approximately 1,000 psi above the hydrostatic pressure initially present in the well at that elevation. Typically, the backup firing head 30, if it is hydraulically actuated, would be constructed to actuate at a pressure 1,000 psi above that at which the primary firing head 32 is constructed to actuate.

Thus it is seen that the apparatus and methods of the present invention readily achieve the ends and advantages mentioned as well as those inherent therein. While certain preferred embodiments of the invention have been illustrated for the purposes of the present disclosure, numerous changes may be made by those skilled in the art which are embodied within the scope and spirit of the present invention as defined by the appended claims.

What is claimed is:

1. A method of perforating a well with a hydraulically actuated perforating gun conveyed on a tubing string having a tubing bore, said method comprising the steps of:

(a) providing said perforating gun and an associated firing head having a differential pressure actuating piston and a firing piston;

(b) lowering said perforating gun and firing head on said tubing string to a selected location within said well;

(c) sealing between said tubing string and a bore of said well with an annular packer thus defining a well annulus between said tubing string and said well bore above said packer and an isolated zone below said packer, aid isolated zone being communicated with said tubing bore of said tubing string and being isolated from said well annulus above said packer, said perforating gun and firing head being located in said isolated zone with said isolated zone communicated with said actuating piston;

(d) increasing fluid pressure in said tubing bore of said tubing string and thus is said isolated zone to a predetermined value;

(e) moving said actuating piston in said firing head in response to said increased pressure in said isolated zone, thereby releasing said firing piston in response to said increased pressure;

(f) after step (e), moving said firing piston; and (g) thereby firing said perforating gun and perforating said well.

2. The method of claim 1, wherein said step (c) is further characterized in that said isolated zone is also communicated with said firing piston; and said step (f) is further characterized in that said firing piston is moved by the fluid pressure in said isolated zone.

3. The method of claim 1, wherein:

said step (a) is further characterized as providing both a primary firing head and a backup firing head associated with said perforating gun, said primary firing head being said first mentioned firing head having said actuating piston and said firing piston.

4. The method of claim 3, wherein:

said step (a) is further characterized in that said backup firing head is also hydraulically actuated in response to increased pressure in said tubing bore and is constructed to fire at a pressure substantially different from said predetermined value of step (d).

5. The method of claim 3, wherein:

said step (a) is further characterized in that said backup firing head is mechanically actuated.

6. The method of claim 1, wherein:

said step (a) is further characterized in that said firing head includes a sealed low pressure chamber communicated with a low pressure side of said actuating piston.

7. The method of claim 6, wherein said step (a) is further characterized in that said sealed low pressure chamber contains substantially atmospheric pressure trapped during assembly of said firing head prior to placement in said well.

8. The method of claim 1, further comprising:

after moving said actuating piston in said step (f), providing a time delay prior to the firing of said perforating gun in said step (g); and during said time delay, reducing fluid pressure in said tubing bore and in said isolated zone to provide an underbalanced condition in said isolated zone at the time said perforating gun is fired and said well is perforated in said step (g).

9. A firing head for a tubing conveyed perforating gun, comprising:

a housing having an actuating port disposed through a wall thereof and communicated with an exterior of said housing;

a differential pressure actuating piston slidably disposed in said housing, said actuating piston and said housing at least partially defining a first chamber communicated with said actuating port and with a high pressure side of said actuating piston, said actuating piston and said housing further at least partially defining a sealed low pressure second chamber communicated with a low pressure side of said actuating piston;

releasable retaining means, operably associated with said actuating piston, for holding said actuating piston in a first position until pressure in said first chamber exceeds a predetermined value;

a firing piston slidably disposed in said housing; and releasable interlocking means, operably associated with both said actuating piston and said firing piston, for holding said firing piston in place relative to said housing until said actuating piston is moved from its first position.

10. The firing head of claim 9, wherein said sealed low pressure second chamber contains substantially atmospheric pressure.

11. The firing head of claim 9, wherein:

said firing piston is also a differential pressure piston having a high pressure side thereof communicated with said first chamber.

12. The firing head of claim 9, further comprising time delay means, operably associated with said firing piston, for providing a sufficient time delay between movement of said firing piston and firing of said perforating gun so that a fluid pressure exterior of said firing head and communicated with said actuating port may be reduced after said releasable interlocking means releases said firing piston and before said perforating gun is fired.

13. The firing head of claim 9 in a combination comprising a tubing conveyed perforating system for perforating a well, said system further including a tubing string having a tubing bore;

a packer means for sealing between said tubing string and a bore of said well to define a well annulus between said tubing string and said well bore above said packer means and an isolated zone of said well below said packer means;

a vent means for communicating said tubing bore with said isolated zone below said packer means;

a perforating gun suspended from said tubing string in said isolated zone; and wherein said firing head is also suspended from said tubing string in said isolated zone, said firing head being operably associated with said gun, said actuating port of said firing head communicating said first chamber of said firing head with said isolated zone of said well.

14. The system of claim 13, further comprising a backup firing head means also suspended from said tubing string and operably associated with said gun.

15. The system of claim 14, wherein:

said backup firing head is also hydraulically actuated in response to increased pressure in said tubing bore at a pressure substantially different from said predetermined value at which said releasable retaining means releases said actuating piston of said first mentioned firing head.

16. The system of claim 14, wherein:

said first mentioned firing head is located above said gun, and said backup firing head is located above said first mentioned firing head.

17. A tubing conveyed perforating system, comprising a tubing string;

a perforating gun suspended from said tubing string; and a primary firing head and a backup firing head, both suspended from said tubing string above said perforating gun, and each including a time delay means for providing a sufficient time delay between initiation of a firing sequence in the respective firing head and subsequent firing of the perforating gun so that an underbalanced condition may be created in said isolated zone of said well prior to firing of said perforating gun.

18. The system of claim 17, wherein:

both said primary firing head and said backup firing head are hydraulically actuated.

19. The system of claim 18, wherein:

both said primary firing head and said backup firing head are actuated in response to an increase in fluid pressure in said tubing string.

20. The system of claim 17, wherein: said backup firing head is located above said primary firing head;

said time delay means of said backup firing head is located substantially along a longitudinal axis of said perforating gun and firing head; and said time delay means of said primary firing head is radially offset from said axis.

* * * * *